US010475604B2

(12) United States Patent
Detlefsen et al.

(10) Patent No.: US 10,475,604 B2
(45) Date of Patent: Nov. 12, 2019

(54) VEHICLE CONTROL PANEL COMPRISING A SWITCH

(71) Applicant: Volvo Car Corporation, Göteborg (SE)

(72) Inventors: Anders Detlefsen, Trollhättan (SE); Johan Setterberg, Göteborg (SE); Moisés Clemente, Torslanda (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 16/168,889

(22) Filed: Oct. 24, 2018

(65) Prior Publication Data

US 2019/0139724 A1 May 9, 2019

(30) Foreign Application Priority Data

Nov. 9, 2017 (EP) ..... 17200705

(51) Int. Cl.
*H01H 21/22* (2006.01)
*H01H 21/08* (2006.01)
(Continued)

(52) U.S. Cl.
CPC ..... *H01H 21/22* (2013.01); *G05G 1/02* (2013.01); *H01H 1/2041* (2013.01); *H01H 21/08* (2013.01); *H01H 23/003* (2013.01); *H01H 23/12* (2013.01); *H01H 1/36* (2013.01); *H01H 2223/004* (2013.01); *H01H 2223/044* (2013.01);
(Continued)

(58) Field of Classification Search
CPC .... H01H 21/22; H01H 2021/225; H01H 1/36; H01H 1/2041; H01H 2300/01; G05G 1/02
See application file for complete search history.

(56) References Cited

U.S. PATENT DOCUMENTS 5,845,767 A * 12/1998 Suzuki ..... H01H 13/562 200/524
6,150,808 A * 11/2000 Yagyu ..... H03K 17/97 324/207.21
(Continued)

FOREIGN PATENT DOCUMENTS

JP 2003022731 A 1/2003

OTHER PUBLICATIONS

Jun. 4, 2018 European Search Report issue on International Application No. EP17200705.

*Primary Examiner* — Felix O Figueroa
(74) *Attorney, Agent, or Firm* — Clements Bernard Walker; Christopher L. Bernard

(57) ABSTRACT

The present invention relates to a vehicle control panel comprising a switch cap comprising electrical connection pads arranged on a side of the switch cap, and an electric circuit printed on an inside surface of the switch cap associated with selecting a state of the function. A panel member has an opening in which the switch cap is pivotally and releasably attached. The panel member has electrical circuit closing members attached on an inner surface of the panel member. Pairs of the electrical connection pads are adapted to coincide and make contact with a respective one of the electrical circuit closing members to close an electric circuit portion in the switch cap such that an external electrical circuitry operates the function.

14 Claims, 5 Drawing Sheets

(51) Int. Cl.

| | |
|---|---|
| ***H01H 1/20*** | (2006.01) |
| ***G05G 1/02*** | (2006.01) |
| ***H01H 23/00*** | (2006.01) |
| ***H01H 23/12*** | (2006.01) |
| *H01H 1/36* | (2006.01) |

(52) U.S. Cl.
CPC ... *H01H 2229/044* (2013.01); *H01H 2300/01* (2013.01)

(56) References Cited

U.S. PATENT DOCUMENTS

| | | | | |
|---|---|---|---|---|
| 6,225,580 | B1 | 5/2001 | Lemire | |
| 9,224,557 | B2 * | 12/2015 | Mori | H01H 23/06 |
| 2006/0243568 | A1 | 11/2006 | Badarneh | |
| 2014/0231233 | A1 | 8/2014 | Mori et al. | |

* cited by examiner

VEHICLE CONTROL PANEL COMPRISING A SWITCH

CROSS-REFERENCE TO RELATED APPLICATION

The present patent application/patent claims the benefit of priority of co-pending European Patent Application No. 17200705.6, filed on Nov. 9, 2017, and entitled "VEHICLE CONTROL PANEL COMPRISING A SWITCH," the contents of which are incorporated in full by reference herein.

FIELD OF THE INVENTION

The present invention relates to a vehicle control panel for controlling a function for a vehicle.

BACKGROUND OF THE INVENTION

Vehicles typically comprise numerous electrical systems for controlling various functions. In modern vehicles more and more functions are incorporated and the electrical systems consequently grow in size and in complexity.

Some vehicles employ electrical touch panel interfaces for controlling the electrical systems and their associated functions. Touch panel interfaces provide a neat appearance and versatility in selecting functions, but they are sensitive to for example exposure to water or other liquids.

Physical knobs and switches are also often employed for controlling electrical systems in vehicles. A physical switch may be used for making a selection for a function in a vehicle. For example, a physical switch is commonly employed in a door control panel of a vehicle for controlling the position of rear view mirrors or the opening and closing of the vehicle windows.

For controlling a function, a switch may be adapted to close or open an electric circuit. The electric circuit is often located below the switch button which is moved by a user for making a selection. When the switch button is moved, an actuator presses against a printed circuit board (PCB) comprising the electric circuit which controls the function. The pressing of the actuator against the electric circuit on the PCB causes the electric circuit to close to thereby operate the function.

However, this type of physical switch comprises many separate parts such as the actuator, the switch button, a PCB comprising the electric circuit, and thus requires some space where it is mounted. In addition, similar to the above mentioned touch panel, the electric circuit on the PCB which is commonly mounted below the switch button is sensitive to liquid. For example, it may happen that liquid is unintentionally spilled inside the vehicle or that water enters the interior of the vehicle from the outside (e.g. rain). This liquid may find its way to the PCB and cause damage to the electric circuit.

Accordingly, there appears to be room for improvement in packaging of a switch and also in protection of the electric circuitry of the switch from liquids.

SUMMARY

In view of above-mentioned prior art, it is an object of the present invention to provide a switch with improved packaging and improved protection from liquid.

According to a first aspect of the invention, there is provided a vehicle control panel for controlling a state of a function for a vehicle, the vehicle control panel comprising:

a switch cap comprising electrical connection pads arranged on a side of the switch cap, and an electric circuit arranged inside the switch cap associated with selecting a state of the function, the electrical connection pads are each electrically connected to respective portions of the electric circuit, and the electric circuit is connected to external electrical circuitry configured to operate the function, a panel member to which the switch cap is pivotally and releasably attached such that the electrical connection pads of the switch cap reaches an inner surface of the panel member, wherein the switch cap is rotatable about a rotation axis with respect to the panel member for rotating between at least two positions, the panel member having electrical circuit closing members attached on the inner surface of the panel member, wherein each of the electrical circuit closing members is configured to close a respective portion of the electric circuit printed in the switch cap, each portion of the electric circuit is associated with a corresponding one of the states, wherein, when in a first position of the at least two positions at least two of the electrical connection pads are adapted to coincide and make contact with one of the electrical circuit closing members in the panel member, whereby a respective first electric circuit portion in the switch cap is closed by the electrical circuit closing member such that the external electrical circuitry thereby operates the function to a first state, and when in a second position of the at least two positions at least two other of the electrical connection pads are adapted to coincide and make contact with another one of the electrical circuit closing members in the panel member, whereby a respective second electric circuit portion in the switch cap is closed by the electrical circuit closing member such that the external electrical circuitry thereby operates the function to a second state.

The present invention is based on the realization that the electric circuit can be integrated in the switch cap by printing it on a surface inside the switch cap or embedding it in the material of the switch cap. In this way, the electric circuit is protected from liquid by the switch cap itself. Furthermore, printing the electric circuit inside the switch cap or embedding it in the switch cap eliminates the need for the PCB traditionally arranged under the switch cap. Thus, in this way the space under prior art control panels which way occupied by PCB and related electronics is, with the inventive concept, made available for other uses.

Accordingly, the invention provides advantages in relation to liquid protection for electric circuits in control panels, and related to packaging of switches.

The switch cap may be formed such that a cavity is formed inside the switch cap. For example, the switch cap may have a dome-like shape, or semi-spherical shape, such that a cavity is formed. The electronic circuit may then be printed on a surface of the switch cap inside the cavity. When the switch cap is arranged in the panel member, the opening of the cavity is arranged to face downwards in a generally vertical direction. In this way, liquid is prevented from flowing or zippering into the cavity of the switch cap. It is generally less likely that liquid flows upwards, and thus reaches the cavity of the switch cap.

The switch cap may be manufactured by injection molding. For example, a first injection molding step provides a base layer for the switch cap. Next, the electric circuit is printed on the base layer, and subsequently the switch cap is completed in a second injection molding step. The electric circuit may be fully or partly embedded in the material applied in the second injection step.

The switch cap may be manufactured using 3D-printer technology where the electronic circuit is printed in the switch cap as part of the manufacturing process of the switch cap. The components of the electric circuit may be mounted on a rack which is mounted on the material of the switch cap before the switch cap is completed. In this way the electronic circuit may be embedded in the switch cap material. It is of course also possible to mount the electronic circuit on a surface of the switch cap, inside the switch cap.

There are of course connection ports accessible in the switch cap for connecting the external electric circuitry to the electric circuit in the switch cap.

The external electric circuitry comprises the necessary components for operating a function, such as active or passive electronic components, electric motors, processors, etc.

The electric circuit may have various configurations. However, the functionality of the electric circuit is to provide an electric signal to the external electric circuitry indicative of the by a user selected state of the function. The external electric circuitry then operates the function to the selected state according to the received electric signal. The electric circuit may comprise e.g. passive and/or active electric components, leads, light-emitting diodes, etc.

The electric circuit may be printed on the inside surface of the switch cap, that is, on a surface inside the cavity. In some embodiments, the electric circuit of the switch cap is at least partly embedded in the material of the switch cap. In other words, at least part or the electric circuit is molded into the material of the switch cap apart form input and output ports for connection with e.g. the external electronic circuit and the electrical connection pads.

The electric circuit comprises a circuit portion for each state of the function to be operated. Each circuit portion is electrically connected to two electrical connection pads. Between the pair of electrical connection pads there is a gap. This gap needs to be closed in order to close the circuit portion such that a signal can be provided to the external electric circuitry. When the two electrical connection pads coincide with an electrical circuit closing member and make contact with the electrical circuit closing member, the circuit portion is closed such that a signal can be provided to the external electric circuitry.

The electrical connection pads are located on an outer side of the switch cap, i.e. not inside the cavity and not integrated in the switch cap. Thus, electrical connections to the electric circuit inside the switch are made through the material of the switch cap.

Furthermore, the electrical connection pads rotate together with a rotation of the switch cap. The electrical circuit closing members are static and remain in their positions on the panel member. The rotation path and possibly also a translation path for the electrical connection pads thus intercepts the location of the electrical circuit closing members.

The panel member is a frame for holding the switch cap in place, and for mounting of the control panel in the vehicle.

The switch cap is reachable for a user from interior of the vehicle for selecting the state of the function. In other words, at least part of the outer side (not the cavity) of the switch cap is visible to a user. For selecting the state of the function, and to consequently cause operation of the function accordingly, the user actuates the switch cap.

The vehicle control panel may comprise an attachment base attached in an opening of the panel member, wherein the switch cap is pivotally and releasably attached to the attachment base. The attachment base advantageously provides for a wider selection of switch cap configurations and sizes. The opening in the panel members is at least partly covered by the attachment base being adapted for a predetermined switch cap, and the switch cap is pivotally and releasably attached to the attachment base.

The releasable attachment of the switch cap in the opening of the panel member may be provided by a snap-fit connection either directly to the panel member or to the attachment base.

The external electric circuitry is arranged away from the vehicle control panel in a different location in the vehicle from the location of the vehicle control panel. However, the external electric circuitry may nevertheless be part of the vehicle control panel although remotely located from the vehicle panel member and the switch cap.

According to embodiments, there may be more than two positions for the switch cap. Accordingly, when the switch cap is in a third position of the at least two positions a third pair of electrical connection pads is adapted to coincide and make contact with a third electrical circuit closing member in the panel member, whereby a respective third electric circuit portion in the switch cap is closed by the electrical circuit closing member such that the external electrical circuitry thereby operates the function to a third state, and when the switch cap is in a fourth position of the at least two positions a fourth pair of electrical connection pads is adapted to coincide and make contact with a fourth electrical circuit closing member in the panel member, whereby a respective fourth electric circuit portion in the switch cap is closed by the electrical circuit closing member such that the external electrical circuitry thereby operates the function to a fourth state.

According to a second aspect of the invention, there is provided a vehicle comprising the vehicle control panel according to the first aspect and embodiments thereof.

The vehicle may be e.g. a car, a truck, a boat, a train, construction equipment, etc.

Further, the function may be to open and close a window of the vehicle. Thus, the function is to operate a window state.

Accordingly, the control panel may control at least two states in the group of states comprising: opening the window by holding the switch cap in one of the positions, automatically opening the window, closing the window by holding the switch cap in another one of the positions, automatically closing the window. The control panel may even control all the states in the group.

Effects and features of the second aspect of the invention are largely analogous to those described above in connection with the first aspect of the invention.

In summary the present invention relates to a vehicle control panel comprising a switch cap comprising electrical connection pads arranged on a side of the switch cap, and an electric circuit printed on an inside surface of the switch cap associated with selecting a state of the function. A panel member has an opening in which the switch cap is pivotally and releasably attached. The panel member has electrical circuit closing members attached on an inner surface of the panel member. Pairs of the electrical connection pads are adapted to coincide and make contact with a respective one of the electrical circuit closing members to close an electric circuit portion in the switch cap such that an external electrical circuitry operates the function.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

These and other aspects of the present invention will now be described in more detail, with reference to the appended drawings showing example embodiments of the invention, wherein.

DETAILED DESCRIPTION OF EXAMPLE EMBODIMENTS

Figure 1:
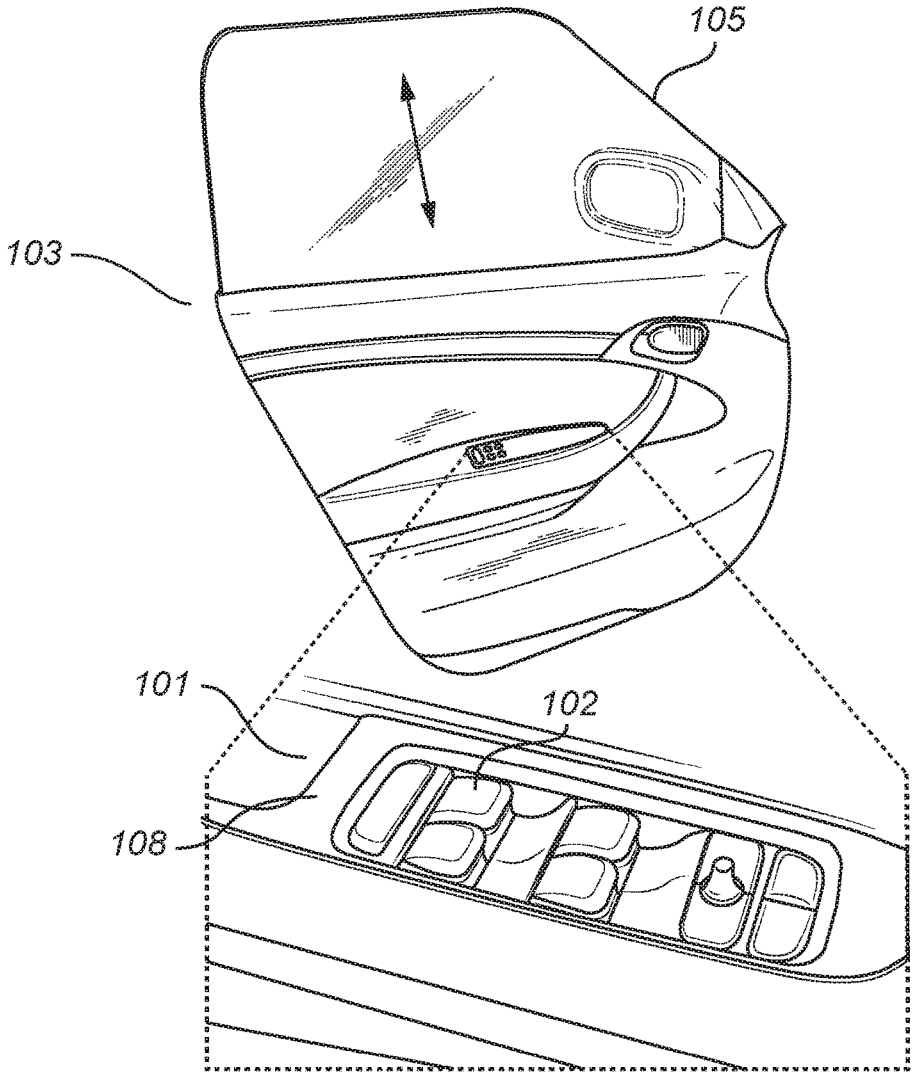
FIG. 1 conceptually illustrates a vehicle door comprising a vehicle control panel according to an example embodiment of the invention.

In the present detailed description, various embodiments of the system and method according to the present invention are mainly described with reference to integration in a vehicle door of a car. However, the present invention may equally be used for any other type of vehicle such as a truck, a train, a bus, a boat, etc., and in other locations in the vehicle than in the vehicle door. Thus, this invention may be embodied in many different forms and should not be construed as limited to the embodiments set forth herein; rather, these embodiments are provided for thoroughness and completeness, and fully convey the scope of the invention to the skilled person. Like reference characters refer to like elements throughout.

FIG. 1 shows a vehicle control panel 101 arranged in a door 103 of a vehicle. The vehicle control panel 101 is in this exemplary embodiment configured to control at least the opening and the closing of at the vehicle windows 105 (only one is shown). Further functions include controlling the position of the rear view mirrors and locking/unlocking the vehicle doors.

In the vehicle control panel 101 there is a switch cap 102 attached to a panel member 108 mounted in the vehicle door 103. The switch cap 102 is reachable from the inside of the vehicle such that a user can control the opening or the closing of the vehicle windows by initiating a rotating action on the switch cap 102.

Figure 2:
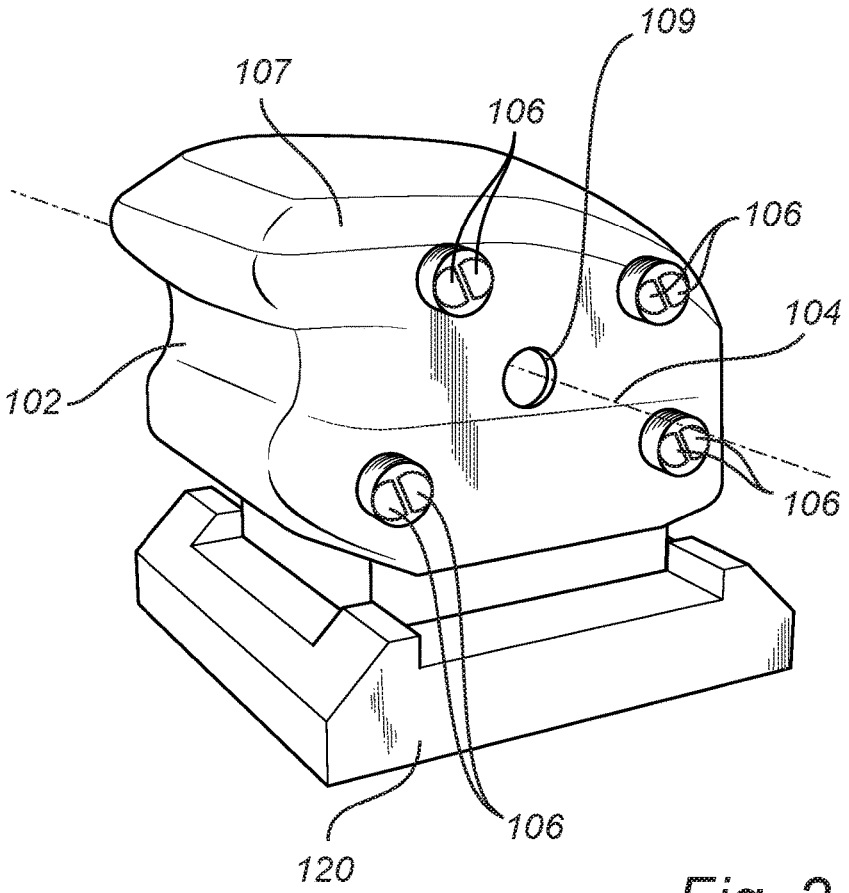
FIG. 2 conceptually illustrates a switch cap comprising electrical connections pads.

FIG. 2 is a close up view of a switch cap 102. The switch cap 102 comprises electrical connection pads 106 arranged on a side 107 of the switch cap 102. Inside the switch cap 102 there is an electric circuit (not shown in FIG. 2) printed on the inside surface (not shown) of the switch cap 102. In this way, the electric circuit is protected from the outside environment by the switch cap 102 itself. The electric circuit may alternatively be at least partly molded into the material of the switch cap 102.

Further, the electrical connection pads 106 are arranged in pairs. Each of the pairs is associated with a state of the function controlled by actuating the switch cap 102. The electrical circuit comprises circuit portions each associated with one state of the function. Each of the circuit portions is connected to a respected pair of electrical connection pads 106. In order to close a circuit portion of the electric circuit to thereby select a state, the electrical connections pads 106 associated with that state must by connected to each other. When the electrical connections pads 106 in one pair is connected to each other the corresponding electric circuit portion is closed and the function is operated to the associated state by an external electric circuitry remote from the vehicle control panel. The state may for example be "open the window" or "close the window".

The state is selected by rotating the switch cap 102 about the rotation axis 104 which thereby moves the electrical connections pads 106 along a rotation path (see FIGS. 5*a-e*) and possible also a translation path. In positions along the rotation path and/or translation path, the pairs of electrical connections pads 106 coincide and make contact with electrical circuit closing members (not shown here). The electrical circuit closing members connects a respective pair of electrical connections pads 106 to each other to close the associated electric circuit portion. The switch cap 102 may be releasably and pivotally attached to the panel member at the rotation axis 104 of the switch cap via connection members (not shown) in the panel member fitting in the hole 109 of the switch cap 102.

FIG. 2 further illustrates an assembly base 120 in which the switch cap 102 is mounted. The assembly base 120 is attached in the panel member shown in FIG. 3.

Figure 3:
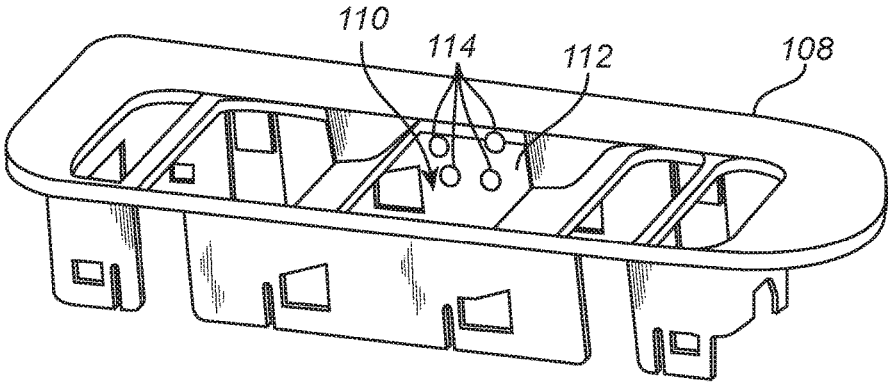
FIG. 3 conceptually illustrates a panel member comprising electrical circuit closing members.

FIG. 3 illustrates a panel member 108 in which the switch cap 102 may be pivotally and releasably attached such that the electrical connection pads 106 of the switch cap 102 reaches an inner surface 112 of the panel member 108. Electrical circuit closing members 114 are attached on the inner surface 112. The switch cap is rotatable with respect to the electrical circuit closing members 114 and the panel member 108 such that the electrical connection pads 106 can make contact with the electrical circuit closing members 114 in different configurations as will be described with reference to FIG. 5-*e*. FIG. 3 further illustrates an opening 110 in which the assembly base 120 may be attached by e.g. screws (not shown). The switch cap 102 may be snap-fitted into the assembly base 120.

Figure 4:
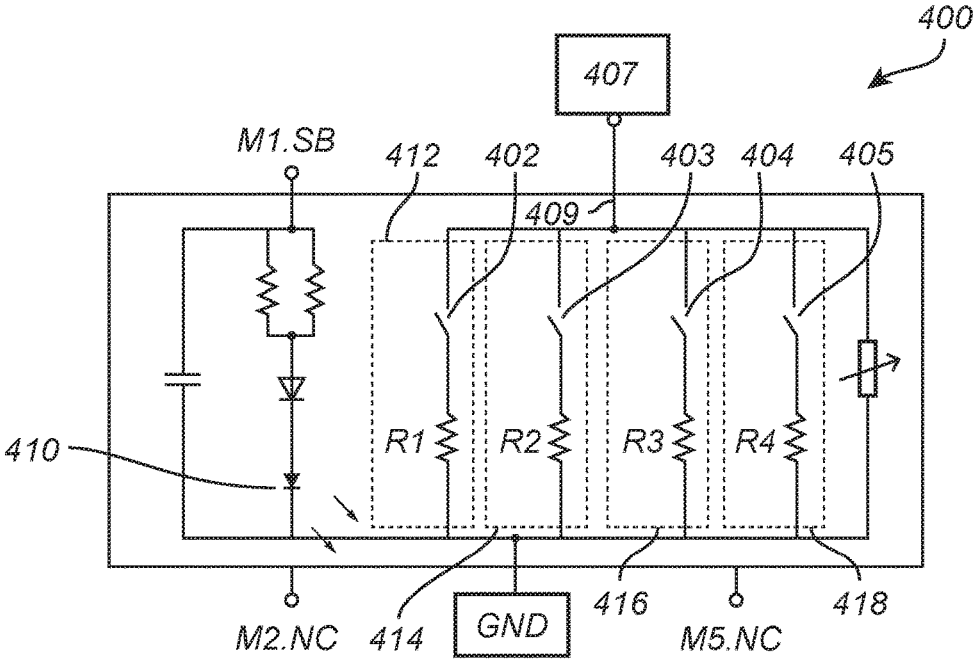
FIG. 4 schematically illustrates a circuit diagram of an example electric circuit in a switch cap.

FIG. 4 schematically shows a circuit diagram of an exemplary electric circuit 400 which may be printed on the inside of the switch cap or be at least partly embedded into the material of the switch cap. Switches 402, 403, 404, 405 indicated in FIG. 4 each schematically represent a pair of electrical connection pads 106 and its respective electric circuit closing member 114. The external electrical circuitry 407 is connected to an output pin 409 of the electric circuit 400 to receive a signal indicative of which state of the function is selected. There is further a light-emitting diode 410 for indicating that the function is operative or used for indicating the location of the switch cap.

In exemplary electric circuit 400 shown in FIG. 4, there is only one output pin 409 connected between the electric circuit 400 comprising the electric circuit portions 412, 414, 416, 418, and the external electrical circuitry 407. In other possible implementations there may be one pin for each of the switches 402, 403, 404, 405.

When one switch is closed, for example switch 402, then the external electrical circuitry 407 can sense a potential on the pin 409 with respect to a reference potential (e.g. a ground potential) which is related to the resistance of resistor R1. If switch 403 is closed then the external electrical circuitry 407 can sense a potential on the pin 409 which is related to the resistance of resistor R2. Similarly, when switch 404 is closed then the external electrical circuitry 407 can sense a potential on the pin 409 which is related to the resistance of resistor R3. The sensed potential when switch 405 is closed is related to the resistance in the resistor R4. The resistance of the resistors R1-R4 is different from each other in order for the external electrical circuitry 407 to be able to distinguish which state of the function has been selected.

The electric circuit 400 may further comprise additional electrical components such as diodes, potentiometers, or other active or passive electrical components, additional connection pins (M2 and M5, not connected, NC). The pin M1.SB is a supply pin for providing power to the light-emitting diode 410 to activate switch cap illumination.

As mentioned above, each pair of electrical connection pads 106 corresponds to a switch in the circuit diagram 400. When the electrical connection pads 106 in a pair are connected to each other corresponds to that the switch is closed and the function is operative in one state. The closing of the electric circuit at the pairs of electrical connection pads 106 will now be described with reference to FIGS. 5*a-e*.

FIG. 5*a-e* schematically illustrates different positions of the switch cap represented by the positions of the electrical connections pads 106 with respect to the electrical circuit closing members 114.

The electric circuit closing members 114 may for example comprise graphite which is a relatively durable material which conducts electrical current. Furthermore, the electric circuit closing members 114 may also comprise graphene, or be made fully from. The graphene may be printed on the surface of the panel member 108. The printing may be made by conventional 3D-printing processes.

Figure 5A:
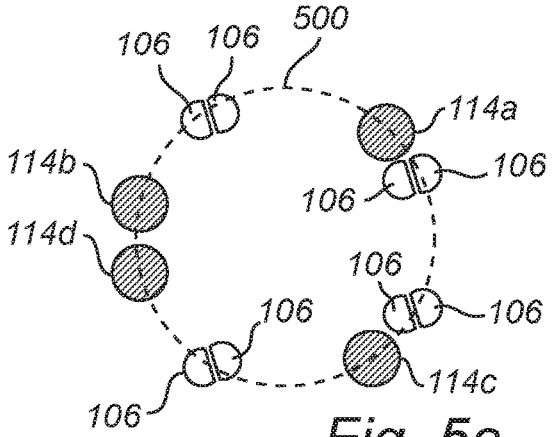
FIG. 5*a-e* schematically illustrate different positions of electrical connections pads with respect to electrical circuit closing members.

FIG. 5*a* illustrates the positions of the electrical connection pads 106 and the electric circuit closing members 114*a-d* in an idle position of the switch cap. In this idle position none of the electrical connection pads 106 coincide and make contact with any one of the electric circuit closing members 114*a-d*. Accordingly, none of the pairs (502-505) of electrical connection pads 106 are connected to each other by an electric circuit closing member 114 whereby none of the circuit portions (412, 414, 416, 418) is closed. Thus, the positions of the electrical connection pads 106 and the electric circuit closing members 114*a-d* as shown in FIG. 5*a* corresponds to that the conceptual switches 402-405 (representing pairs of electrical connection pads 106 and the associated electric circuit closing members) are open whereby the external electric circuitry is not instructed to operate the function in any of the states.

Figure 5B:
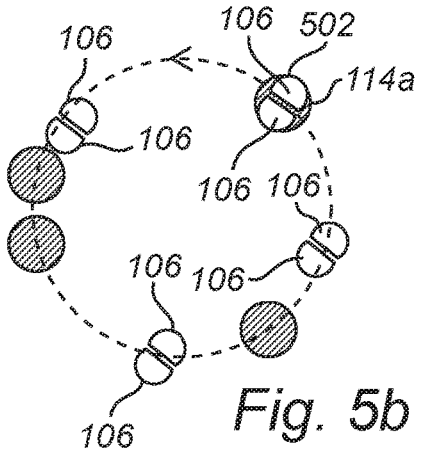

FIG. 5*b* illustrates the positions of the electrical connection pads 106 and the electric circuit closing members 114*a-d* in a first position of the switch cap. In order to reach the first position, the switch cap has been rotated in a counter-clockwise direction in the illustrated example. Consequently, the electrical connection pads 106 have travelled along the rotational path 500 in the counter-clockwise direction. In this first position of the switch cap, the electrical connection pads 106 in the pair 502 coincide and make contact with the electrical circuit closing member 114*a*. Thereby, the electrical circuit closing member 114*a* electrically connects the electrical connection pads 106 in the pair 502 to each other whereby the electric circuit portion associated with the pair 502 is closed. That the electrical connection pads 106 in the pair 502 are connected to each other as illustrated in FIG. 5*b* may correspond to that the switch 402 in the first circuit portion 412 is closed. Thereby, the external electric circuitry is operative to operate the function to a first state. The first state may be to open a vehicle window by holding and maintaining the switch cap in the first position. In other words, keep opening the window further as long as the first circuit portion 412 is closed.

Figure 5C:
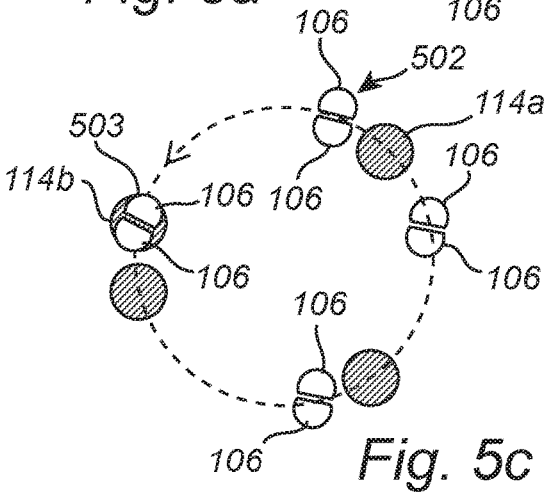

If the switch cap is further rotated in the counter-clockwise direction, the electrical connection pads 106 are caused to travel further along the rotational path 500 in the counter-clockwise direction, as is conceptually illustrated in FIG. 5*c*. As shown in FIG. 5*c*, the pair 502 of electrical connection pads 106 is no longer in contact with the electrical circuit closing member 114*a*, whereby the external electric circuitry no longer operates the function in the first state. Instead, the switch cap has now been rotated to a further position in which the pair 503 of electrical circuit pads 106 coincides and makes contact with the electric circuit closing member 114*b*. Thereby, the electrical circuit closing member 114*b* electrically connects the electrical connection pads 106 in the pair 503 to each other whereby the electric circuit portion associated with the pair 503 is closed. That the electrical connection pads 106 in the pair 503 are connected to each other as illustrated in FIG. 5*c* may correspond to that the switch 403 in the second circuit portion 414 is closed. Thereby, the external electric circuitry is operative to operate the function to a further state, e.g. a second state. This further state may be to automatically open the window.

Figure 5D:
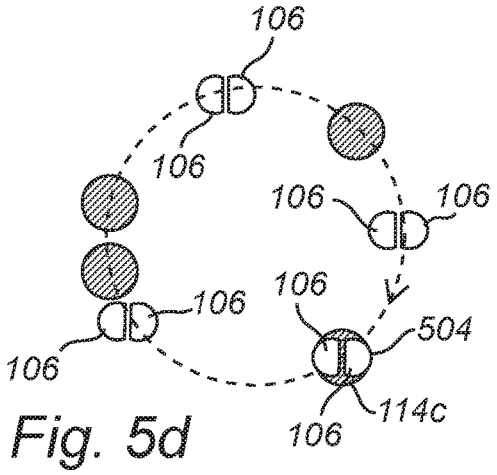

If the switch cap is instead rotated in the clockwise direction from the idle position conceptually illustrated in FIG. 5*a*, the electrical connection pads 106 are caused to travel along the rotational path 500 in the clockwise direction, as is conceptually illustrated in FIG. 5*d*. Accordingly, FIG. 5*d* illustrates the positions of the electrical connection pads 106 and the electric circuit closing members 114 in yet another position of the switch cap, e.g. in a third position. In this position of the switch cap, the electrical connection pads 106 in the pair 504 coincide and make contact with the electrical circuit closing member 114*c*. Thereby, the electrical circuit closing member 114*c* electrically connects the electrical connection pads 106 in the pair 504 to each other whereby the circuit portion associated with the pair 504 is closed. That the electrical connection pads 106 in the pair 504 are connected to each other as illustrated in FIG. 5*b* may correspond to that the switch 404 in the third circuit portion 416 is closed. Thereby, the external electric circuitry is operative to operate the function to yet another state, e.g. a third state. This state may be to close a vehicle window by holding and maintaining the switch cap in the third state. In other words, keep closing the window further as long as the third circuit portion 416 is closed.

Figure 5E:
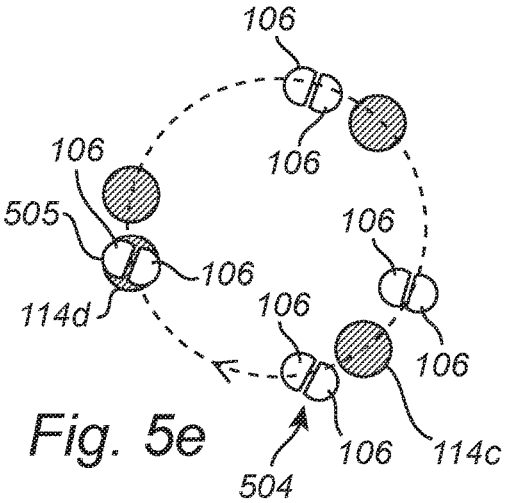

If the switch cap is further rotated in the clockwise direction, the electrical connection pads 106 are caused to travel further along the rotational path 500 in the clockwise direction, as is conceptually illustrated in FIG. 5*e*. As shown in FIG. 5*e*, the pair 504 of electrical connection pads 106 is no longer in contact with the electrical circuit closing member 114*c*, whereby the external electric circuitry no longer operates the function in the third state. Instead, the switch cap has now been rotated to a further position in which the pair 505 of electrical circuit pads 106 coincides and makes contact with the electric circuit closing member 114*d*. Thereby, the electrical circuit closing member 114*d* electrically connects the electrical connection pads 106 in the pair 505 to each other whereby the circuit portion associated with the pair 505 is closed. That the electrical connection pads 106 in the pair 505 are connected to each as illustrated in FIG. 5*e* may correspond to that the switch 405 in the fourth circuit portion 418 is closed. Thereby, the external electric circuitry is operative to operate the function to a further state, e.g. a fourth state. This fourth state may be to automatically close the window.

It should be noted that the rotational path along which the electrical connection pads travels in FIG. 5*a-e* is not the only possible path in accordance with the inventive concept and thus within the scope of the claims, but is merely shown as a conceptual example. For example, the path may comprise a translational motion in addition to the rotational motion along the path 500 depending on the location of the electrical connection pads 106 with respect to a rotation center of the switch cap.

Figure 6:
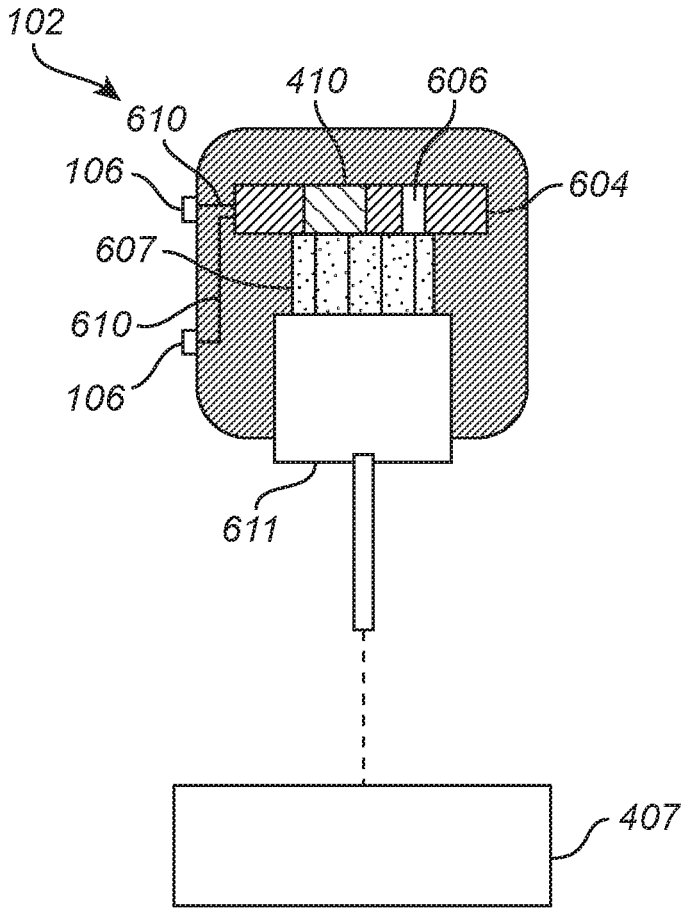
FIG. 6 is a schematic cross-sectional view of a switch cap.

FIG. 6 schematically illustrates a cross-sectional view of a switch cap 102. The switch cap 102 has an electric circuit 604 integrated inside of the switch cap 102. The electric circuit 604 may for example resemble the circuit diagram as shown in FIG. 4, although other circuit diagrams are possible as long the electric circuit is capable of providing signals to the external electric circuitry 407 which operates the function in accordance with the inventive concept.

The electric circuit 604 may be printed on an inside surface of the switch cap, or the electric circuit 604 may be embedded in the material of the switch cap 102. The embedding may be accomplished by molding the electric circuit into the switch cap 102 material. The switch cap 102 may be manufactured by 3d-printing technology. In the example switch cap 102 in FIG. 6, the electric circuit 604 is embedded in the material of the switch cap 102. The electric circuit 604 comprises electrical components 606 such as resistors, capacitors, etc., and a light-emitting diode 410.

FIG. 6 further shows a connection pin unit 607 which may comprise a set of connection pins or in some cases, for example when the electric circuit is provided as illustrated in FIG. 4, a single connection pin 409. A connector 611 is shown connected to the connection pin unit 607 for receiving indications of which state of the function is selected. The connector 611 is connected to the external electrical circuitry 407 using known transmission buses such as CAN-bus and/or wireless communication capabilities. The external electrical circuitry 407 may comprise a control unit for controlling the function.

In addition, FIG. 6 schematically illustrates electrical connection pads 106 (only two are shown) on the side of the switch cap 102. The electrical connection pads 106 are electrically connected to the electric circuit 604 via interconnecting leads 610 arranged through the material of the switch cap 102, e.g. in the form of vias.

The electrical connection pads 106 may be provided in various forms and shapes and may comprise copper, gold, aluminum, or any other electrically conductive material. Furthermore, the electrical connection pads 106 illustrates in FIGS. 2 and 5*a-e* are only conceptually illustrating the electrical connection pads as two closely spaced electrical connection pads which may be electrically connected to each other by an electric circuit closing member which makes contact with both of the two electrical connection pads.

Figure 7:
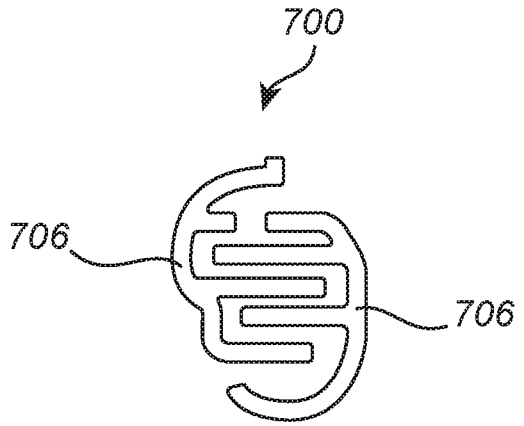
FIG. 7 schematically illustrates a pair of electrical connection pads.

Variations in the shape of the electrical connection pads is possible, for example, a further possible configuration of electrical connection pads 706 is shown in FIG. 7 which illustrates a pair 700 of electrical connection pads 706. The electrical connection pads 706 are somewhat comb-shaped and are interleaved with each other but not in contact with each other. The interleaving of the comb-shaped electrical connection pads 706 enables improved electrical contact between the electrical connection pads 706 in the pair 700 when a electric circuit closing member overlaps with both the electrical connection pads 706 in the pair 700.

The control unit may include a microprocessor, microcontroller, programmable digital signal processor or another programmable device.

The person skilled in the art realizes that the present invention by no means is limited to the preferred embodiments described above. On the contrary, many modifications and variations are possible within the scope of the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. Any reference signs in the claims should not be construed as limiting the scope.

The invention claimed is:

1. A vehicle control panel for controlling a function for a vehicle, the vehicle control panel comprising:

a switch cap comprising electrical connection pads arranged on a side of the switch cap, and an electric circuit arranged inside the switch cap associated with selecting a state of the function, the electrical connection pads are each electrically connected to respective portions of the electric circuit, and the electric circuit is connected to external electrical circuitry configured to operate the function, a panel member to which the switch cap is pivotally and releasably attached such that the electrical connection pads of the switch cap reaches an inner surface of the panel member, wherein the switch cap is rotatable about a rotation axis with respect to the panel member for rotating between at least two positions, the panel member having electrical circuit closing members attached on the inner surface of the panel member, wherein each of the electrical circuit closing members is configured to close a respective portion of the electric circuit printed in the switch cap, each portion of the electric circuit is associated with a corresponding one of the states, wherein, when in a first position of the at least two positions at least two of the electrical connection pads are adapted to coincide and make contact with one of the electrical circuit closing members in the panel member, whereby a respective first electric circuit portion in the switch cap is closed by the electrical circuit closing member such that the external electrical circuitry thereby operates the function to a first state, and when in a second position of the at least two positions at least two other of the electrical connection pads are adapted to coincide and make contact with another one of the electrical circuit closing members in the panel member, whereby a respective second electric circuit portion in the switch cap is closed by the electrical circuit closing member such that the external electrical circuitry thereby operates the function to a second state.

2. The vehicle control panel according to claim 1, wherein the switch cap is reachable for a user from interior of the vehicle for selecting the state of the function.

3. The vehicle control panel according to claim 1, comprising an attachment base attached in an opening of the panel member, wherein the switch cap is pivotally and releasably attached to the attachment base.

4. The vehicle control panel according to claim 1, wherein the switch cap is snap-fitted in place in the attachment base or snap-fitted in place directly in the panel member.

5. The vehicle control panel according to claim 1, comprising the external electrical circuitry arranged away from the vehicle control panel.

6. The vehicle control panel according to claim 1, wherein the electric circuit of the switch cap is at least partly embedded in the material of the switch cap.

7. The vehicle control panel according to claim 1, wherein when the switch cap is in a third position of the at least two positions a third pair of electrical connection pads is adapted to coincide and make contact with a third electrical circuit closing member in the panel member, whereby a respective third electric circuit portion in the switch cap is closed by the electrical circuit closing member such that the external electrical circuitry thereby operates the function to a third state, and when the switch cap is in a fourth position of the at least two positions a fourth pair of electrical connection pads is adapted to coincide and make contact with a fourth electrical circuit closing member in the panel member, whereby a respective fourth electric circuit portion in the switch cap is closed by the electrical circuit closing member such that the external electrical circuitry thereby operates the function to a fourth state.

8. The vehicle control panel according to claim 1, wherein the external electric circuitry comprises an electric motor for operating the function.

9. The vehicle control panel according to claim 1, wherein the switch cap comprises four pairs of electrical connection pads and the panel member comprises four electric circuit closing members.

10. The vehicle control panel according to claim 1, wherein the electrical connection pads are arranged in pairs each adapted to coincide and make contact with one of the electrical circuit closing members, wherein the electrical connection pads in the pairs are comb-shaped and interleaved with each other without making contact with each other.

11. A vehicle comprising the vehicle control panel according to claim 1.

12. The vehicle according to claim 11, wherein the function is to open and close a window of the vehicle.

13. The vehicle according to claim 12, wherein the control panel controls at least two states in the group of states comprising:

opening the window by holding and maintaining the switch cap in one of the positions, automatically opening the window, closing the window by holding the switch cap in another one of the positions, automatically closing the window.

14. The vehicle according to claim 13, wherein the control panel controls all the states in the group.

* * * * *